United States Patent [19]

Magendans et al.

[11] Patent Number: 4,534,993

[45] Date of Patent: Aug. 13, 1985

[54] METHOD OF MANUFACTURING A ROTARY ANODE FOR X-RAY TUBES AND ANODE THUS PRODUCED

[75] Inventors: Frederik Magendans; Gerhardus A. te Raa; Bernhard J. P. van Rheenen, all of Eindhoven, Netherlands

[73] Assignee: U.S. Philips Corporation, New York, N.Y.

[21] Appl. No.: 569,869

[22] Filed: Jan. 11, 1984

[30] Foreign Application Priority Data

Jan. 25, 1983 [NL] Netherlands ..... 8300251

[51] Int. Cl.[3] ..... B05D 1/08

[52] U.S. Cl. ..... 427/34; 378/144

[58] Field of Search ..... 427/34, 423; 219/121 PL; 378/125, 143, 144; 445/28

[56] References Cited

U.S. PATENT DOCUMENTS

| | | | |
|---|---|---|---|
| 3,493,415 | 2/1970 | Grisaffe | 427/34 |
| 3,839,618 | 10/1974 | Muehlberger | 427/34 |
| 3,875,444 | 4/1975 | Magendans et al. | 378/144 |
| 4,090,103 | 5/1978 | Machenschalk et al. | 427/34 |
| 4,132,916 | 1/1979 | Hueschen et al. | 427/34 |
| 4,224,273 | 9/1980 | Magendans et al. | 378/144 |
| 4,320,323 | 3/1982 | Magendans et al. | 427/423 |
| 4,327,305 | 4/1982 | Weber | 378/144 |

*Primary Examiner*—John H. Newsome

*Attorney, Agent, or Firm*—Robert J. Kraus

[57] ABSTRACT

A layer of W or of a W-alloy is provided on a forged supporting member of an X-ray rotary anode by plasma spraying. By carrying out the plasma spraying at reduced pressure, a layer is obtained which is suitable as a target layer for X-ray rotary anodes.

11 Claims, 1 Drawing Figure

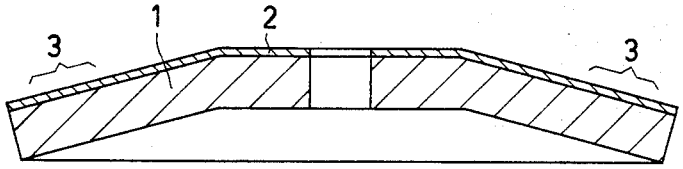
1
2
3
3

METHOD OF MANUFACTURING A ROTARY ANODE FOR X-RAY TUBES AND ANODE THUS PRODUCED

BACKGROUND OF THE INVENTION

The invention relates to a method of manufacturing a rotary anode for X-ray tubes, in which a support member is manufactured from a molybdenum alloy and a target layer of tungsten or a tungsten alloy is provided on the support member by plasma spraying.

The invention also relates to the rotary anode obtained by means of said method.

It is an object ot the invention to provide a rotary anode which can be used in X-ray tubes which are used at a high load, for example, X-ray tubes for medical purposes.

German Patent Application No. 23 46 925 discloses a method of manufacturing an anode in which a target layer (i.e. the layer which is bombarded by the electrons when the rotary anode is used in an X-ray tube) of tungsten or a tungsten-rhenium alloy is provided on a support member of cast molybdenum or a molybdenum alloy. It is stated in the Patent Application that the target layer can be provided by plasma-spraying. However, details which might enable the production of dense layers by this process are not given.

With plasma-spraying of tungsten or tungsten alloys at atmospheric pressure, according to the literature, it is generally not possible to obtain a density higher than approximately 92–94% of the theoretical maximum density (see, for example, R. Glätzle et al, Metall 24, 823 et seq. 1970). Such a density is insufficient for rotary anodes; it is not possible to maintain a proper vacuum in the X-ray tube with such a density.

It has been tried to increase the density by densely sintering the tungsten layer. A maximum density of 97% of the theoretical maximum density is then obtained (R. Glätzle et al. ibid.). The prescribed sintering treatment (up to 15 hours at 2600° C.) causes an unacceptable loss of strength of many molybdenum alloys normally used for support members so that the use in an X-ray tube becomes impossible. Plasma spraying tungsten under reduced pressure is known per se from Moses A. Levinstein, Cienca Y technica de la Soldadure (Madrid) 12, No. 66, pp. 1–9 (1962) (see also Chemical Abstracts 58, 1963), 4243f). However, a density of not more than 92.7% of the theoretical maximum density was then obtained. It is also stated that reduction of pressure resulted in lower densities.

A method of plasma spraying materials, for example, tantalum, tungsten carbide and the like, in which plasma currents are used at speeds of Mach 3 is known from E. Muehlberger "A high-energy plasma coating process", Proc. 7th Intern. Metal Spraying Conf. 1973, London (see also U.S. Pat. No. 3,839,618). To obtain such velocities, spraying is effected in a chamber at a pressure of less than half an atmosphere and preferably much less. However, experiments have demonstrated that although in this manner layers of sufficient ensities are obtained, the resulting layers nevertheless are unfit to serve as target layers because in the method described the necessary process conditions cause the tungsten particles virtually to be deposited at a temperature which is too low because a globular structure having too little mutual bonding between the particles is obtained.

SUMMARY OF THE INVENTION

It has been surprisingly found that when a considerably reduced quantity of plasma gas is used (approximately 1/5 of that used in the abovedescribed method) and a higher opposition pressure so that plasma flows having only subsonic to sonic speeds are generated, tungsten layers are obtained which have both a good mutual bonding between the particles and a high density. These layers have proved to be very suitable as target layers for X-ray rotary anodes.

A method according to the invention is characterized in that a cylindrical member of a molybdenum alloy having a density larger than or equal to 90% of the theoretical maximum density is deformed while increasing the circumference and reducing the height at a degree of deformation of at least 70% to form a flat disc, the resulting disc is given the shape of the basic member by a mechanical process, after which the basic member is preheated and a layer of tungsten or a tungsten alloy having a density of at least 97% of the theoretical maximum density and a thickness between 0.2 and 2 mm is provided by plasma spraying in an atmosphere which comprises less than 1% by volume of oxygen at a pressure between 20 and 70 kPa, the basic member being rotated and having a temperature from 1000°–1600° C., the resulting layer being optionally aftertreated and annealed.

The basic member in the method according to the invention is preferably preheated at a temperature above 1000° C. before the target layer is provided. This results in a higher density and a better bonding of the target layer to the basic member.

In order to obtain an optimum density, it is preferred to use a tungsten (alloy) powder having a particle size of at most 45 μm. A suitable tunsten alloy is, for example, a tungsten-rhenium alloy.

BRIEF DESCRIPTION OF THE DRAWING

The invention will now be described in greater detail with reference to the accompanying diagrammatic drawing, the sole FIGURE of which shows a rotary anode obtained by using the method according to the invention.

DESCRIPTION OF THE PREFERRED EMBODIMENT

The drawing shows a rotary anode constructed from a supporting member 1 and a target 2. The portion of the target layer indicated by 3 is the place onto which the electron beam in the X-ray tube is focused (focal path 3).

The support 1 may consist of molybdenum or any known molybdenum alloy for X-ray rotary anodes which can be strengthened by deformation. Particularly suitable is a cast or sintered alloy consisting of 0.40–0.60% by weight of Ti, 0.05–0.12% by weight of Zr and 0.01–0.05% by weight of C, remainder Mo; an alloy comprising 5% by weight of W, remainder Mo, and molybdenum which contains 0.25–1.50% by weight of $Y_2O_3$.

One or more further layers may be present between the target layer and the basic member 1, for example, a layer of pure tungsten and the like. The target layer 2 consists of tungsten or a tungsten alloy. All alloys known for this purpose are suitable. Particularly good results have been obtained with tungsten-rhenium alloys (up to 10% by weight of rhenium) and with tungsten-rhenium-tantalum alloys (up to 10% by weight of rhenium, up to 4% by weight of tantalum).

The surface of the target layer, except for the focal path (3), and/or of the basic member, may be roughened to improve the thermal radiation or for the same purpose it may be lined with thermal radiation-improving materials (for example, a rough tungsten layer or a layer consisting of $Al_2O_3$ with $TiO_2$).

It is possible for the target layer to have a composition gradient (for example, of the rhenium content) which varies through the layer thickness.

The rotary anode is manufactured as follows. A cylinder consisting of cast or sintered molybdenum alloy the circumference and the height of which have been so chosen that with a single blow of high energy a disc of the desired thickness and diameter having a deformation degree of at least 70% can be obtained, is preheated at 1000°–1400° C. and placed between the blocks of a press and subjected to a high-speed deformation impact process.

A high speed deformation impact process is to be understood to mean in this connection a deformation process in which a workpiece is deformed with a single blow of high energy content in a device comprising flat metal press blocks. Devices for carrying out such a method are known per se and are commercially available. Very good results can be obtained by means of a device in which the press blocks are moved toward each other at high speed by means of gas pressure (so-called pneumatic-mechanical machines).

During and after deformation, no crystallization of the resulting deformed structure occurs in this type of deformation. During the deformation process the density increases to nearly the theoretical maximum density provided the initial density is at least 90% of the theoretical density. The deformation degree in the above-mentioned alloys preferably is 80% or more since the highest strength is obtained hereby.

The resulting disc is then given the correct shape by mechanical treatments and, optionally, deformation by pressing and bending.

The surface of the basic member is thoroughly cleaned by means of standard degreasing methods.

The basic member is then placed in a special hermetically sealable chamber. The chamber is evacuated, rinsed and filled with Ar with an $O_2$ content smaller then 20 ppm. It is alternatively possible to use He or $N_2$. All the gases may be used while mutually mixed and/or mixed with $H_2$ (0–25% by volume). This cycle is preferably repeated a few times so as to remove virtually all the oxygen from the chamber. The chamber is finally filled with any of the above-mentioned gases or gas mixture to the desired pressure (20–70 kPa). A pressure of 30–50 kPa is preferably used and maintained during spraying. The material for the target layer is then sprayed onto the basic member by means of a plasma gun. (Approximately 60 kW of power is supplied to the plasma gun.) The rotating basic member is preferably preheated at a temperature above 1000° C. (1100°–1600° C.) by means of the plasma gun for 0.5 minutes before the material of the target layer having a particle size 10–37 $\mu$m is sprayed. It is possible to vary the composition of the sprayed material continuously so as to obtain a gradient in the composition of the target layer. The target layer is preferably provided in a layer thickness from 0.5–1.5 mm while the basic member is rotated. It is possible to provide the target layer at just the area of the focal path 3 by means of a mask.

After termination of the plasma spraying process, the basic member plus target layer is allowed to cool in the chamber. The resulting product is finally removed from the chamber and further processed, the focal path 3 then being ground.

By means of the method according to the invention a density of more then 97% of the theoretical maximum density was obtained in all the above tungsten alloys. Moreover, the target layer readily adhered and the layer was suitable to serve as a target layer, i.e. the layer has:

a good mutual bonding between the particles, so no particles will be detached from the layer during use no abnormal gas release in the tube.

The resulting discs have an unbalance smaller than 1 gramm cm.

What is claimed is:

1. In a method of manufacturing a rotary anode for an X-ray tube, said rotary anode comprising a support member consisting essentially of a molybdenum alloy on which a target layer consisting essentially of tungsten or a tungsten alloy is provided by plasma spraying, the improvement comprising:

(a) deforming a cylindrical member of said molybdenum alloy, having a density of at least 90% of its theoretical maximum density, by means of a high speed deformation impact process to form a disc having a smaller height and larger circumference than said cylindrical member, the degree of deformation being at least 70%;

(b) mechanically shaping the disc to form the support member;

(c) placing the support member in a gaseous atmosphere containing less than 1% by volume of oxygen and having a pressure between 20 and 70 kilopascals; and (d) in said gaseous atmosphere, plasma spraying the target layer onto the support member to a thickness between 0.2 and 2.0 millimeters while rotating said support member and maintaining it at a temperature between 1000° C. and 1600° C., said layer having a density at least equal to 97% of the theoretical maximum density.

2. A method as in claim 1 wherein the cylindrical member comprises a cast alloy consisting essentially of molybdenum alloyed with 0.40–0.55% by weight of titanium, 0.06–0.12% by weight of zirconium and 0.01–0.03% by weight of carbon.

3. A method as in claim 1 where the cylindrical member comprises a sintered alloy consisting essentially of molybdenum alloyed with 0.40–0.60% by weight of titanium, 0.05–0.12% by weight of zirconium and 0.01–0.05% by weight of carbon.

4. A method as in claim 1 where the cylindrical member comprises a cast alloy consisting essentially of molybdenum alloyed with approximately 5% by weight of tungsten.

5. A method as in claim 1 where the cylindrical member comprises a sintered alloy consisting essentially of molybdenum alloyed with approximately 5% by weight of tungsten.

6. A method as in claim 1 where the cylindrical member comprises a sintered alloy consisting essentially of molybdenum alloyed with 0.25–1.50% by weight of $Y_2O_3$.

7. A method as in claim 1, 2, 3, 4, 5 or 6 where said degree of deformation is at least 80%.

8. A method as in claim 1, 2, 3, 4, 5 or 6 where the support member is preheated to a temperature of at least 1000° C. before plasma spraying the target layer thereon.

9. A method as in claim 1, 2, 3, 4, 5 or 6 where the plasma spraying step comprises the plasma spraying of a powder of tungsten or of a tungsten-rhenium alloy having a particle size between 5 and 45 microns.

10. A method as in claim 1, 2, 3, 4, 5 or 6 where said gaseous atmosphere has a pressure between 30 and 50 kilopascals.

11. A method as in claim 1, 2, 3, 4, 5 or 6 where said target layer consists essentially of tungsten alloyed with 0–10% by weight of rhenium and 0–4% by weight of tantalum.

* * * * *